US007396325B2

(12) United States Patent
Meinig et al.

(10) Patent No.: US 7,396,325 B2
(45) Date of Patent: Jul. 8, 2008

(54) CENTRIFUGE ROTOR

(75) Inventors: Uwe Meinig, Walsrode (DE); Dieter Baumann, Greven (DE)

(73) Assignee: Hengst GmbH & Co. KG, Muenster (DE)

( * ) Notice: Subject to any disclaimer, the term of this patent is extended or adjusted under 35 U.S.C. 154(b) by 0 days.

(21) Appl. No.: 11/667,842

(22) PCT Filed: Apr. 28, 2006

(86) PCT No.: PCT/EP2006/003963

§ 371 (c)(1),
(2), (4) Date: May 16, 2007

(87) PCT Pub. No.: WO2006/117142

PCT Pub. Date: Nov. 9, 2006

(65) Prior Publication Data

US 2008/0051278 A1 Feb. 28, 2008

(30) Foreign Application Priority Data

May 2, 2005 (DE) ..... 20 2005 007 156 U

(51) Int. Cl.
*B04B 7/12* (2006.01)
*B04B 9/06* (2006.01)

(52) U.S. Cl. ..... 494/49; 494/74

(58) Field of Classification Search ..... 494/24, 494/36, 43, 49, 56, 64, 65, 67, 83, 84, 901, 494/74, 79; 210/168, 171, 232, 360.1, 380.1, 210/416.5; 184/6.24
See application file for complete search history.

(56) References Cited

U.S. PATENT DOCUMENTS

| | | | | |
|---|---|---|---|---|
| 2,755,992 | A | 7/1956 | Tait et al. | |
| 6,183,407 | B1 * | 2/2001 | Hallgren et al. | 494/49 |
| 6,224,531 | B1 * | 5/2001 | Frehland et al. | 494/49 |
| 6,364,822 | B1 | 4/2002 | Herman et al. | |
| 6,793,615 | B2 * | 9/2004 | South et al. | 494/38 |

(Continued)

FOREIGN PATENT DOCUMENTS

| | | |
|---|---|---|
| EP | 1277515 | 1/2003 |

(Continued)

*Primary Examiner*—Charles E Cooley
(74) *Attorney, Agent, or Firm*—Greer, Burns, Crain, Ltd

(57) ABSTRACT

The invention relates to a rotor for a centrifuge, in particular for purifying lubricating oil in an internal combustion engine, wherein said rotor is rotatably mounted in the centrifuge housing and is provided with an impurity trapping element, the rotor or the impurity trapping element thereof are made of a plastic material and remote deflecting baffles arranged in said impurity trapping element can be removed from the centrifuge housing. The invention is characterized in that the inventive rotor or the impurity trapping element thereof comprises a lower part and a top part, lower deflecting baffles are provided in the lower part, top deflecting baffles are provided in the top part, the lower and top parts are congruently welded to each other, the deflecting baffles are incorporated into the welded connection and through openings, which connect the chambers of the impurity trapping element delimited by said deflecting baffles to each other in a fluid permeable manner, are embodied in at least one part of the deflecting baffles on one or two sides of the welded connection or on the plane thereof.

21 Claims, 7 Drawing Sheets

U.S. PATENT DOCUMENTS

| | | | | |
|---|---|---|---|---|
| 7,182,724 | B2 * | 2/2007 | South | 494/49 |
| 2003/0162645 | A1 | 8/2003 | South et al. | |
| 2004/0157719 | A1 | 8/2004 | Amirkhanian et al. | |
| 2008/0051278 | A1 * | 2/2008 | Meinig et al. | 494/56 |

FOREIGN PATENT DOCUMENTS

| | | | |
|---|---|---|---|
| EP | 1340547 | | 9/2003 |
| EP | 10 2004 005920 | | 8/2004 |
| WO | WO 02/45864 | | 6/2002 |
| WO | 2006/117142 | A1 * | 11/2006 |

* cited by examiner

CENTRIFUGE ROTOR

BACKGROUND OF THE INVENTION

The invention relates to a rotor for a centrifuge, in particular for purifying lubricating oil in an internal combustion engine, wherein said rotor is rotatably mounted on a rotary axis in a centrifuge housing and provided with an impurity trapping element having an impurity collecting area and being delimited radially towards the outside by means of a circumferential wall, the rotor as a whole or its impurity trapping element being made of a plastic material and, on the interior of the impurity trapping element, a plurality of deflecting baffles being provided which are spaced apart from each other in circumferential direction and the rotor as a whole or its impurity trapping element able to be removed from the centrifuge housing for maintenance purposes.

Centrifuges and the rotors used therein for the purification of liquids, e.g. for the purification of lubricating oil in an internal combustion engine, have been widely used for decades and are accordingly known.

In the design of rotors for centrifuges, the objective is to accelerate the liquid entering the impurity trapping element as loss-free as possible to the angular velocity of the rotating rotor and, conversely, to return the spin energy of the liquid as far as possible to the rotor when the liquid flows out of the impurity trapping element. To this end, deflecting baffles are generally arranged in the impurity trapping element which extend radially or spirally and reduce the slip between the liquid and the rotor and thus improve the conditions for the separation of impurity particles—not only in terms of the achievable rotor speeds, but also with regard to the relative velocity of the liquid in relation to the impurity particles separated in the impurity trapping element. For rotors made of sheet metal, this function is usually realized by means of the embossments forming deflecting baffles on one front side or on both front sides of the rotor.

Taking into account a problem-free disposal of the separated impurity—this is essentially soot in the case of lubricating oil as the liquid to be cleaned—rotors and, respectively, impurity trapping elements made of a plastic material are increasingly used in new developments of centrifuges. Such rotors or impurity trapping elements provide the opportunity to thermally dispose of the filled rotor or, respectively, the filled impurity trapping element in a simple and relatively environmentally compatible manner.

One disadvantage in the use of rotors or impurity trapping elements made of a plastic material is that the strength of plastic materials is significantly below that of metallic materials. This disadvantage is especially evident when the rotor or the impurity trapping element must have an axially squat design with a large outside diameter—as is frequently necessary due to specified mounting space factors.

Another problem—especially in the filling stage of the rotor or the impurity trapping element during the run-up phase of the centrifuge—is that it cannot be excluded that individual chambers separated from each other by the deflecting baffles will be irregularly filled. This irregular filling of the chambers is connected with an unbalance and as a result thereof with reduced rotor speeds, vibration accelerations, and noise emissions.

SUMMARY OF THE INVENTION

Accordingly, an object of the invention is to create a rotor of the type stated above which will avoid the presented disadvantages and which ensures—especially when using plastic as the material—that the rotor will have a high mechanical strength and good service life, as well as good true running without unbalances and with economic producibility.

This problem is solved according to the invention with a rotor of the type mentioned above, characterized in that

- the rotor or its impurity trapping element comprises a lower part and a top part;
- lower deflecting baffle parts are provided in the lower part and top deflecting baffle parts are provided in the top part;
- the lower part and the top part are congruently welded with each other;
- the deflecting baffle parts are incorporated into the welded connection; and
- that openings, which connect the chambers of the impurity trapping element delimited by said deflecting baffles to each other in a fluid permeable manner, are provided in at least one part of the deflecting baffles on one or two sides of the welded connection or on a plane thereof.

Economic manufacture of the rotor or its impurity trapping element will be enabled due to the fact that the rotor comprises a lower part and a top part into which the lower and, respectively, the top deflecting baffle parts are each integrated and which are tightly welded to each other. In particular due to the fact that the deflecting baffle parts are incorporated into the welded connection, a particularly strong cohesion of the two rotor parts will be achieved which results in a mechanically especially resistant and permanently high-strength rotor or impurity trapping element without the risk of damaging deformations in operation. The additionally provided openings according to the invention ensure a uniform filling of all chambers formed by the deflecting baffles in the rotor or the impurity trapping element, especially during the startup phase of the centrifuge so that good true running of the rotor will be ensured without interfering and damaging unbalances even in this operating phase which is critical per se.

To be able to provide the welded connection as easily as possible and to prevent the welded connection from becoming the source of unbalance, the welded connection is preferably provided in a joining plane extending perpendicularly to the rotary axis.

An additional embodiment proposes that the lower deflecting baffle parts and the top deflecting baffle parts extend congruously to each other on their front side which faces the respectively other deflecting baffle parts over their entire length. In this embodiment, the deflecting baffle parts can be welded with each other over relatively large areas within the scope of the welded connection between the lower part and the top part so that they will here provide a correspondingly major contribution to the high form stability of the rotor.

It is moreover preferably provided that the lower deflecting baffle parts and/or the top deflecting baffle parts are designed, on their front side facing the respectively other deflecting baffle parts, with a comb- or tooth-shaped structure pointing in axial direction. With this embodiment, the openings in the deflecting baffles can be advantageously manufactured simply and economically, because the comb- or tooth-shaped structure can be designed, on the front sides of the deflecting baffle parts, without any appreciable additional expense during the preliminary production of the lower part and the top part of the rotor or the impurity trapping element. Thus, no complex and expensive machining will be required to produce the openings.

The invention moreover proposes that the comb- or tooth-shaped structures of deflecting baffle parts adjacent to each other in circumferential direction comprise an offset in radial direction relative to each other. This offset will ensure that, seen in the circumferential direction of the rotor, no continuous flow paths can be formed for the liquid present in the rotor. Thus, efficient entrainment of the liquid will be ensured during the rotation of the rotor, especially during its acceleration. Moreover, high relative velocities between the liquid in the rotor and the already settled impurity particles are prevented so that any flushing away of already deposited impurity particles will also be prevented.

Another preferred embodiment proposes in addition that the number of deflecting baffles is even, that the comb- or tooth-shaped structures form a regular pattern with a pattern space A, and that the offset is equivalent to half the pattern space. In this embodiment, when considering two wall parts adjacent in circumferential direction on a specific radius, one fluid permeable opening will always be facing one fluid impermeable comb tip or tooth by means of which the desired prevention of continuous flow paths in circumferential direction will be securely effected.

According to the invention, it is furthermore proposed that the comb- or tooth-shaped structure is only provided in the lower part. In this embodiment, only the lower part comprises the somewhat more complex geometry with the comb- or tooth-shaped structure of the lower deflecting baffle parts here arranged, whereas the top part can be designed with simple smooth front sides of its deflecting baffles.

It is furthermore possible that the lower deflecting baffle parts seen in circumferential direction comprise a greater wall thickness than the top deflecting baffle parts. With relatively minor additional expenditure in material, the wall thickness of the lower deflecting baffle parts can be increased. The comb tips or the teeth of the comb- or tooth-shaped structure will thereby be provided with high strength which will protect them against damage as long as the lower part is not yet welded to the top part. Moreover, this increased wall thickness can balance out small positioning inaccuracies in circumferential direction when welding the lower part and the top part of the rotor or the impurity trapping element since an adequate surface still remains for the welded connection between the lower and the top deflecting baffle parts.

Another embodiment of the rotor provides that the lower deflecting baffle parts and the top deflecting baffle parts have—on their front side facing the respectively other deflecting baffle parts—a course deviating from each other over part of their length. In this embodiment, the desired openings connecting the chambers in the impurity trapping element will be simply designed in the areas in which the front sides of the top and the lower deflecting baffle parts deviate in their course from each other such that they are not connected with each other.

According to a concrete further development, it is preferably provided that the lower deflecting baffle parts and/or the top deflecting baffle parts are designed, at least in the area of their front side facing the respectively other deflecting baffle parts, with a wave- or zigzag-shaped structure pointing into the radial direction. To design the openings, it will be sufficient that one of the deflecting baffle parts each comprises the wave- or zigzag-shaped structure. When both deflecting baffle parts are correspondingly structured, reduced structuring of each deflecting baffle part will be sufficient which can be advantageous in terms of the technical side of production.

It is furthermore proposed that the wave- or zigzag-shaped structures of deflecting baffle parts adjacent to each other in axial direction comprise an offset in radial direction relatively to each other. The front sides of the deflecting baffle parts adjacent to each other in axial direction will cross each other in this manner, preferably repeatedly, thereby also providing—in addition to a plurality of openings—a plurality of welding areas between the top and the lower deflecting baffle part, at their crossings.

In terms of the technical side of production, it is advantageous that the wave- or zigzag-shaped structures each form a regular shape with a wave length A, and the offset will be equivalent to half the wave length.

Preferably, the number of the deflecting baffles in the rotor according to the invention will amount to six or eight or ten, and quite generally, the number of the deflecting baffles should become larger with the increasing size, in particular with the increasing diameter of the rotor, to ensure the desired stability of the rotor even at high speeds and high liquid temperatures, such as they occur e.g. with lubricating oil of an internal combustion engine.

Another contribution for achieving high stability and economic manufacturability of the rotor is that, preferably, the lower deflecting baffle parts are designed in one piece with the lower part, and the top deflecting baffle parts are designed in one piece with the top part, and that the lower part and the top part are each an injection molded part. With a suitable design of lower part and top part, a relatively simple "open/closed" injection tool will be sufficient for their manufacture, the tool enabling removal from the mold in one single removal direction and thus being economical not only in its production but also in its use in the injection molding of the parts of the rotor.

Depending on the embodiment of the centrifuge, the rotor or its impurity trapping element can be designed without a radial inner ring wall or with a radial inner ring wall. For the first mentioned embodiment, it is preferably provided according to the invention that the deflecting baffle parts will freely end radially on the inside in one axially extending edge and that the edge is in each case realized with a stiffening enlargement. The enlargement of the edge will each provide for the adequate stabilization of the free edge so that no damages in the operation of the centrifuge need to be expected here, even if the deflecting baffle parts and the deflecting baffles formed thereby are not radially connected inside to another area of the rotor or the impurity trapping element.

For embodiments of the rotor with a radially interior ring wall, the invention proposes that the deflecting baffles will turn as one piece radially inside into the radially interior ring wall or form-fittingly or frictionally engage in it or abut to it. In the embodiments with a one-piece transition or with form-fitting or frictional engaging, the forces acting in radial direction between the interior ring wall and the deflecting baffles can be transmitted which is advantageous for the stability of the rotor. With a corresponding design of the rotor or the impurity trapping element, this transmission of radial forces can also be waived so that it will then be sufficient when the deflecting baffles only abut radially inside to the radially interior ring wall.

Another advantageous measure for increasing the stability and the load-carrying capacity of the rotor is that, in the lower part and/or in the top part seen in circumferential direction, one rib or a plurality of ribs each are provided between the lower and/or the top deflecting baffles which extend radially towards the inside from the circumferential wall and which are radially shorter than the deflecting baffle parts. Additionally, these ribs also provide for an entrainment of the liquid in the rotor or the impurity trapping element when the rotor is running up and when the liquid enters the rotor. Moreover, the ribs provide for a safe hold of the impurity particles deposited radially outside by the centrifugal forces, said particles depositing between the ribs as well as between the ribs and the deflecting walls and are thus efficiently protected against flushing off by means of the liquid flowing through the rotor or the impurity trapping element.

Moreover, the invention proposes that the lower part has a smaller axial height than the top part, with the height of the lower part preferably coming to between 20% and 50% of the height of the top part. This embodiment provides the advantage that the openings in the deflecting baffles located at the height of the welded connection will come to lie in a lower area of the interior of the rotor or the impurity trapping element which is advantageous for an early uniform filling of the chambers between the deflecting baffles. Thus, already at a low liquid filling level of the rotor or the impurity trapping element, liquid will overflow from the already higher filled chambers into the chambers which are not yet filled with liquid up to the height of the openings. For good true running of the rotor or the impurity trapping element, it is advantageous to achieve a balance of the liquid levels in the individual chambers as early as possible. This will be achieved by means of the lowest possible arrangement of the openings in the rotor or the impurity trapping element.

To ensure high safety and stability of the welded connection between lower part and top part, it is furthermore proposed that the lower part and the top part are each designed with a welded flange on their circumferential wall. When the lower part and the top part are realized radially inside without a ring wall, the welded flanges are only provided on the radially exterior circumferential wall of the lower part and the top part; when the lower part and the top part are realized with a radially interior ring wall, it is here also possible to provide a welded flange each on the lower part and the top part.

In terms of a fast and reliable and accordingly economic production, the welded connection is preferably a welded connection produced by arc welding or butt welding.

The plastic material of which the lower part and the top part are made will preferably be polyamide since this material meets the mechanical as well as thermal requirements, and because it is, at the same time, relatively economical and can be readily extruded and welded.

BRIEF DESCRIPTION OF THE DRAWINGS

Exemplary embodiments of the invention will be explained below in detail on the basis of a drawing. In the Figures of the drawing.

DETAILED DESCRIPTION OF THE PREFERRED EMBODIMENTS

Figure 1:
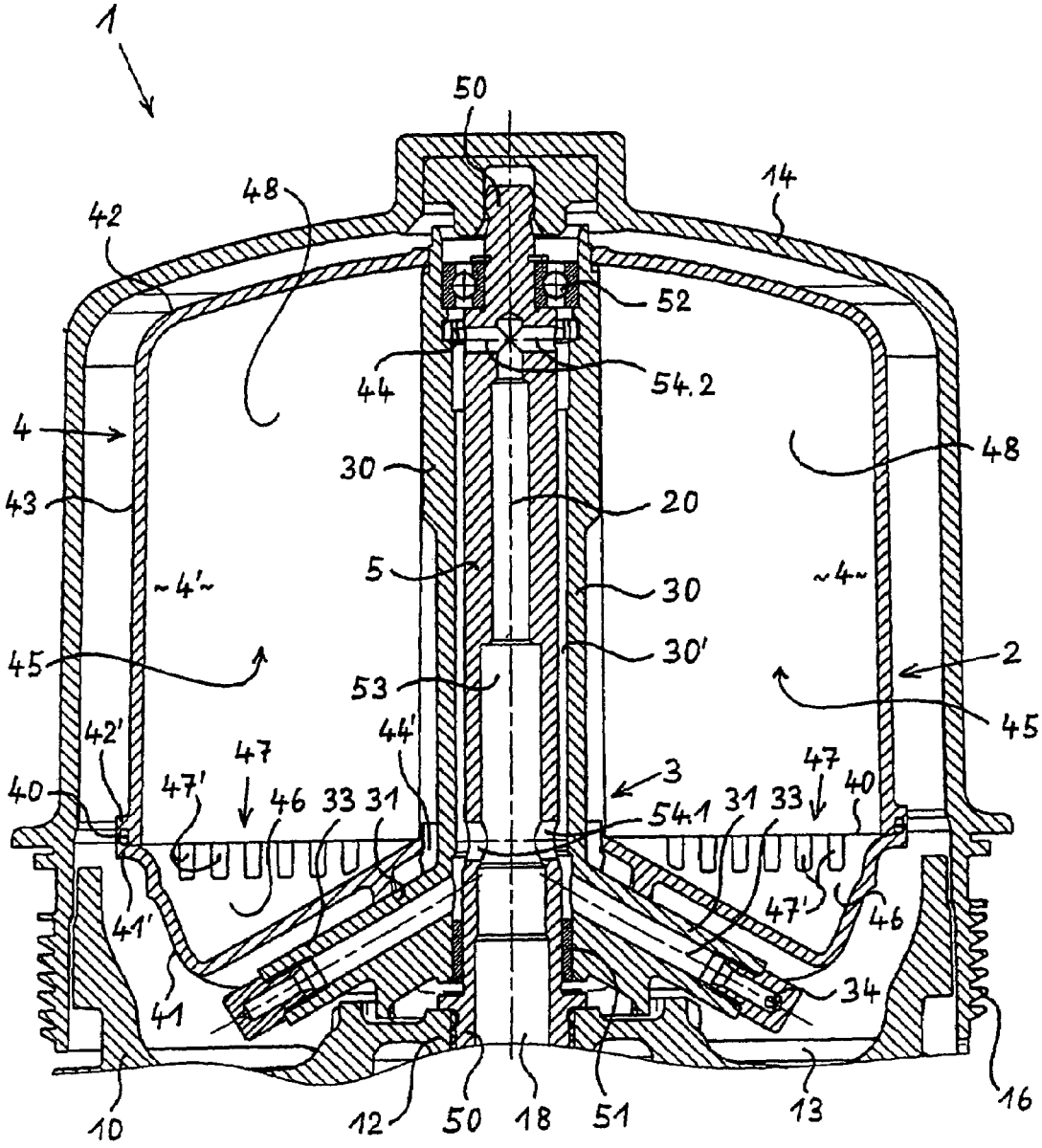
FIG. 1 shows, in a longitudinal section, a centrifuge with a rotor arranged therein.

According to FIG. 1, the centrifuge 1 comprises a housing 10 only partially shown here whose top part is formed by a screw cap 14. At its lower end, the screw cap 14 has an external thread 16 which can be screwed into an internal thread here not shown which is formed as part of the housing 10.

A rotor 2 of the centrifuge 1 is provided on the inside of the housing 10, here essentially within the cap 14. The rotor 2 is arranged on an axis 5 stationarily provided in the centrifuge 1 and can be rotated about a vertically extending rotary axis 20. A sliding bearing 51 provided in the lower part of the axis 5 and a roller bearing 52 provided close to the top end of the axis 50' are used for it.

In the example presented here, the rotor 2 comprises a bearing and drive part 3, as well as an impurity trapping element 4 detachably connected therewith.

In its top part, the bearing part 3 consists of a tubular body 30 which surrounds the axis 5 by forming a ring gap 30' and with the intermediate layer of the two mentioned bearings 51 and 52. From the lower area of the tubular body 30, two nozzle arms 31 extend in two diametrically opposed radial directions and one liquid channel 33 each runs through them. At the end of each liquid channel 33, a recoil nozzle 34 is arranged—here screwed in or pressed in—by means of which the rotor 2 can be rotary driven according to the recoil principle by one liquid jet each ejected. The bearing and drive part 3 is here designed as a lifetime component and is thus expediently made of metal or a suitable plastic.

The impurity trapping element 4 is a replacement part which can be replaced or cleaned from time to time for the purpose of servicing the centrifuge 1. With unscrewed cap 14, the impurity trapping element 4 can be pulled off for this from the bearing and drive part 3 upwardly in axial direction. The impurity trapping element 4 is made of plastic for weight and cost reasons and for the purpose of easy disposal.

Here, the impurity trapping element 4 is composed of a lower part 41 and a top part 42 which are connected to each other permanently and in a fluid impermeable manner by means of a welded connection 40. Furthermore, on the inside of the impurity trapping element 4, deflecting baffles 45 are provided extending in radial direction, two of which are visible in FIG. 1. These deflecting baffles 45 extend not only through the lower part 41 but also through the top part 42 of the impurity trapping element 4.

The deflecting baffles 45 are each composed of a lower deflecting baffle part 46 formed as one piece in the lower part 41 and of a top deflecting baffle part 48 formed as one piece in the top part 42. Here, the lower deflecting baffle parts 46 and the top deflecting baffle parts 48 are incorporated into the welded connection 40 between the lower part 41 and the top part 42.

As furthermore evident from FIG. 1, the lower deflecting baffle parts 46 are each designed with a comb- or tooth-shaped structure 47 on their upwardly facing front side. After the welded connection 40 is provided, this structure 47 will result in openings 47' being provided in the deflecting baffles 45 below the joining level of this welded connection 40. These openings 47' ensure that—between the deflecting baffles 45 regularly spaced from each other in circumferential direction—uniform filling with liquid will result, and thus a uniform liquid level without unbalances when filling the rotor 2. Thus, good true running without unbalances will be ensured even in an otherwise critical starting phase of the rotor 2. At the same time and due to the described welded connection 40, the deflecting baffles 45 formed from the lower deflecting baffle parts 46 and the top deflecting baffle parts 48 provide for high strength and permanent stability of the impurity trapping element 4, even at high mechanical and thermal loads.

During the operation of centrifuge 1, a liquid to be cleaned—e.g. lubricating oil of an internal combustion engine—will flow from the bottom through an inlet 18 into a central channel 53 which extends in axial direction through the axis 5. The inflowing liquid stream will here be divided into two partial streams. A first partial stream flows through two first radial openings 54.1 through the axis 5 radially to the outside and then passes—through the ring gap 30'—into the liquid channels 33 in the nozzle arms 31. From the channels 33, this liquid stream will exit through the nozzles 34 and provides for the drive of the rotor 2.

A second partial liquid stream flows through the channel 53 in the axis 5 further to the top and then enters the inside of the impurity trapping element 4 through two additional radial openings 54.2 close to the top end of the axis 50' and through at least one liquid inlet 44. During the rotation of rotor 2, the impurity particles carried along in the liquid will be moved radially towards the outside by means of the centrifugal force and are deposited in an impurity collecting area 4' located radially outside in the impurity trapping element 4. This impurity collecting area 4' is delimited towards the radial outside by means of an exterior circumferential wall 43.

The liquid to be cleaned flows through the impurity trapping element 4, coming from the liquid inlet 44, essentially axially from the top to the bottom, and it leaves the impurity trapping element 4 through a liquid outlet 44' provided in it on the bottom and radially on the inside. The purified liquid exiting through the liquid outlet 44' as well as the liquid exiting through the nozzles 34 arrive in a pressureless area 13 of the centrifuge housing 10 and will flow off from there by the force of gravity.

As illustrated in FIG. 1, the joining level of the welded connection 40 is provided at a relatively low position in the impurity trapping element 4. Accordingly, the openings 47' are thus also far on the bottom in the impurity trapping element 4. This will ensure that upon the startup of the centrifuge 1, the inflowing liquid will rise already very soon up to the height of the openings 47' and can then be distributed in circumferential direction uniformly over the entire impurity trapping element 4 within the chambers delimited by the individual deflecting baffles 45. Thus, there will be no unevenly high liquid level in the individual chambers which would result in unbalances.

If, after a prolonged operating period of the impurity trapping element 4, an impurity particle cake has built up radially outside within the impurity collecting area 4', the radially exterior openings 47' can actually be closed thereby; however, this will not result in any functional disadvantage since yet other openings 47' exist radially further on the inside which will remain permeable to fluid.

To facilitate tight and permanent welding of the lower part 41 and the top part 42 of the impurity trapping element 4, the lower part 41 has, on its top edge, a welding flange 41 running in circumferential direction. In analogously mirror symmetrical design, the top part 42 has, on its lower edge, a circumferential welding flange 42'. The welded connection 40 is preferably a welded connection produced by arc welding or butt welding.

Figure 2:
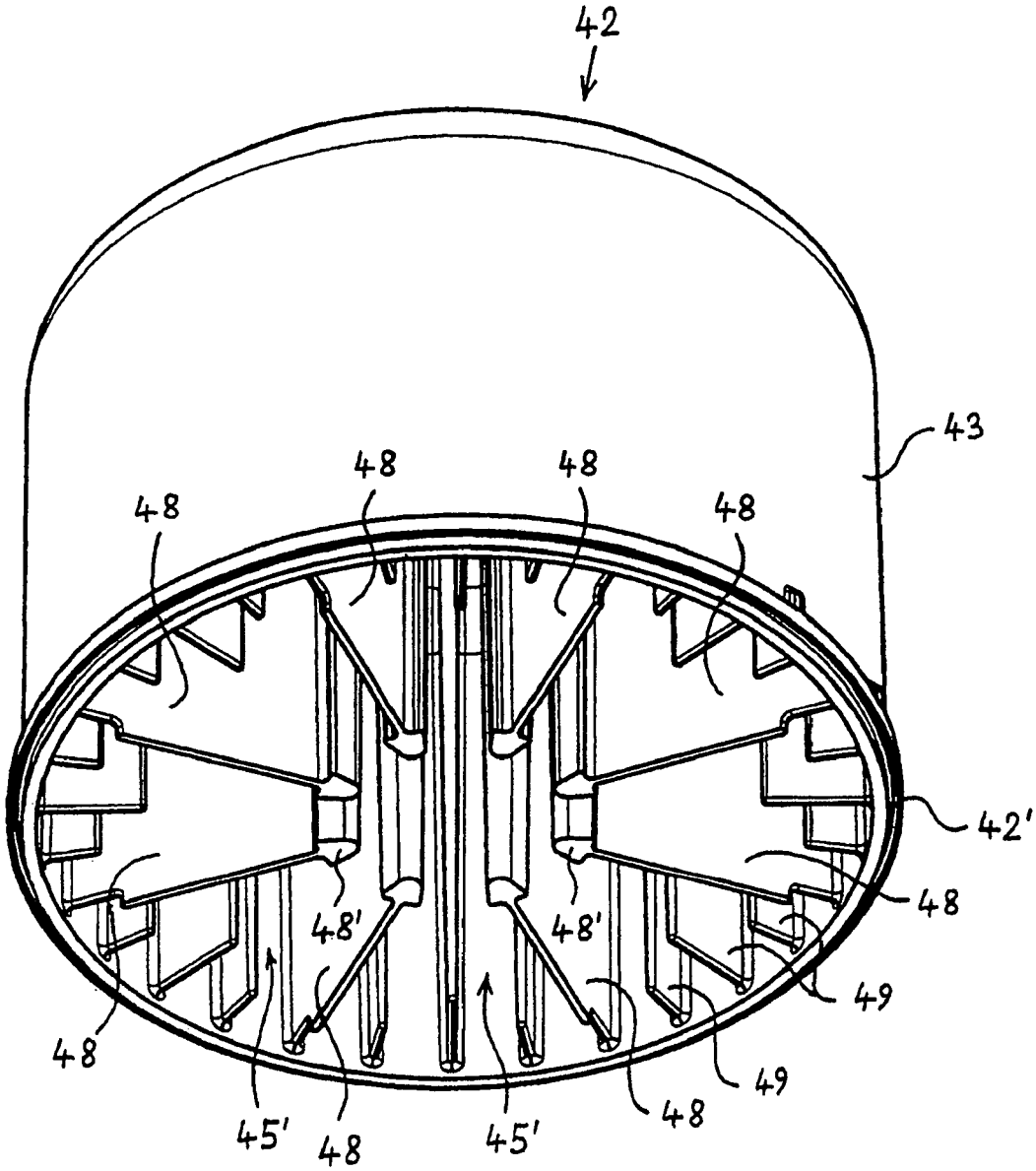
FIG. 2 shows a top part of the rotor of FIG. 1, in a perspective view from below.

In a perspective view at an angle from below, FIG. 2 shows the top part 42 of the impurity trapping element 4 of FIG. 1 prior to its connection with the lower part 41. Radially towards the outside, the top part 42 is delimited by the circumferential wall 43. The regularly spaced apart top deflecting baffle parts 48 of the deflecting baffles 45 are visible on the inside of the top part 42. Between each two adjacent deflecting baffle parts 48, three ribs 49 are here additionally formed in each case which also extend in radial direction from the interior surface of the circumferential wall 43 radially inwardly, but which are significantly shorter in radial direction than the deflecting baffle parts 48.

On their radially interior end, the deflecting baffle parts 48 are each designed with an edge thickening 48' to achieve at this point increased stability and strength. The top deflecting baffle parts 48 as well as the ribs 49 are designed as one piece with the circumferential wall 43 and with the welding flange 42' provided on its lower end. Expediently, the entire top part 42 is a one-piece injection molded part.

Figure 3:
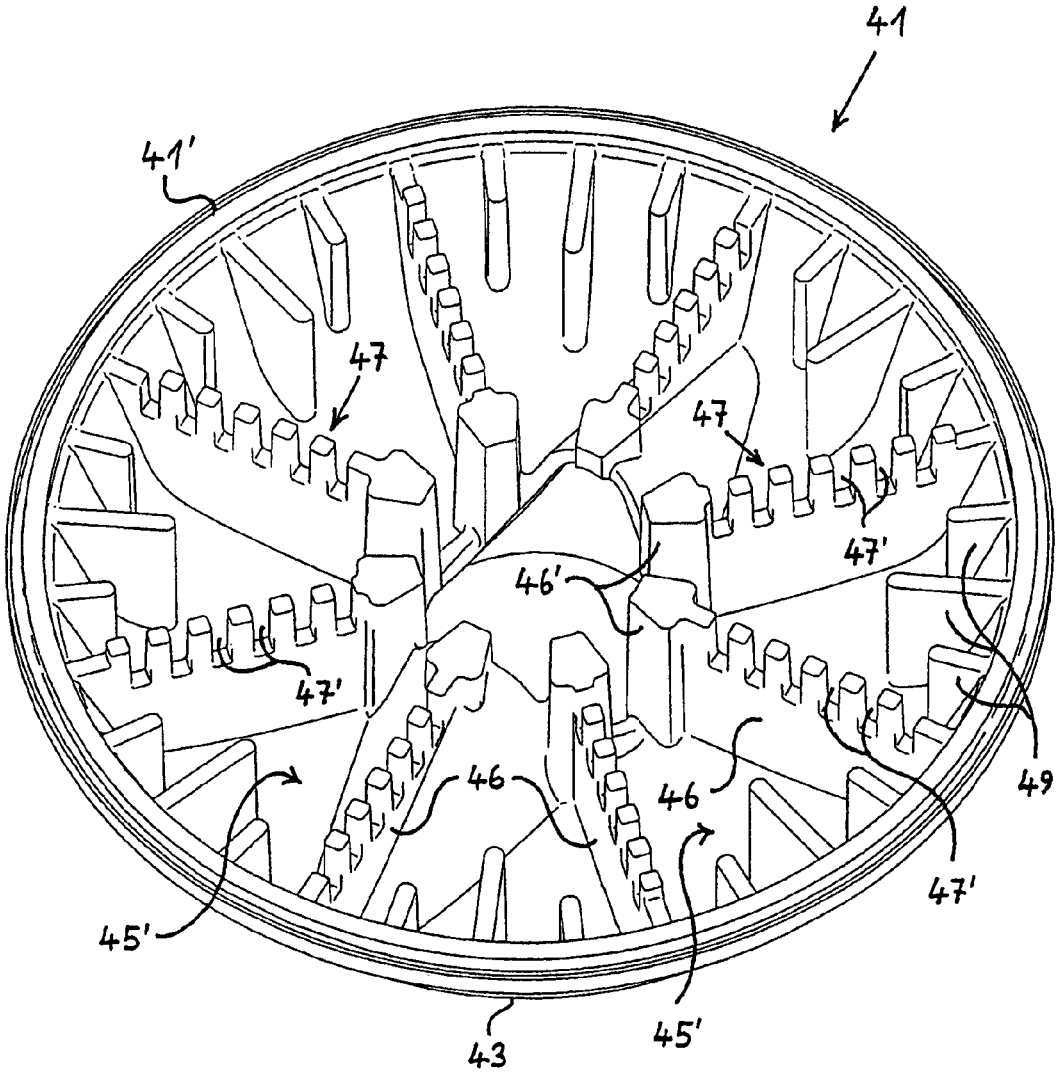
FIG. 3 shows a lower part of the rotor of FIG. 1, in a perspective view from above.

FIG. 3 shows the lower part 41 of the impurity trapping element of FIG. 1 in a perspective view at an angle from the top prior to its connection with the top part 42. The inside of the lower part 41 is shown here, with the regularly spaced apart lower deflecting baffle parts 46 being visible here. On their top side, the lower deflecting baffle parts 46 are each designed with the comb- or tooth-shaped structure 47.

When looking at two lower deflecting baffle parts 46 adjacent in circumferential direction, it is apparent that the structures 47 have an offset relative to each other in radial direction. It will prevent continuous flow paths in circumferential direction for the liquid in the lower part 41. This results in improved balancing of the impurity trapping element 4 filling up with liquid or, respectively, filled with liquid.

Radially inside, the lower deflecting baffle parts 46 also end freely here and are realized with an edge thickening 46' to increase the stability in this area.

In the lower part 41 as well, three ribs 49 each are formed between two lower deflecting baffle parts 46 each adjacent in circumferential direction, the ribs here also starting from the circumferential wall 43 and extending radially inside, but being significantly shorter in this radial direction than the lower deflecting baffle parts 46.

The lower part 41 here presented can also be advantageously manufactured as a one-piece injection molded part and, at the same time, the comb- or tooth-shaped structure 47 can also be formed, without any problem, in each case on the top side of the lower deflecting baffle parts 46. During the manufacture of the lower part 41, the comb- or tooth-shaped structures 47 are designed with an initially enlarged height seen in axial direction to provide material for producing the welded connection. Moreover, in the example presented, the lower deflecting baffle parts 46 with their structure 47 are designed with an increased material thickness relative to the top deflecting baffle parts 48 to achieve a greater strength of the comb tips of the structure 47 and a greater amount of material for the welding process. Moreover, due to this increased material thickness, smaller angle errors can be balanced out in the positioning of lower part 41 and top part 42 relative to each other for their welding with each other.

Figure 4:
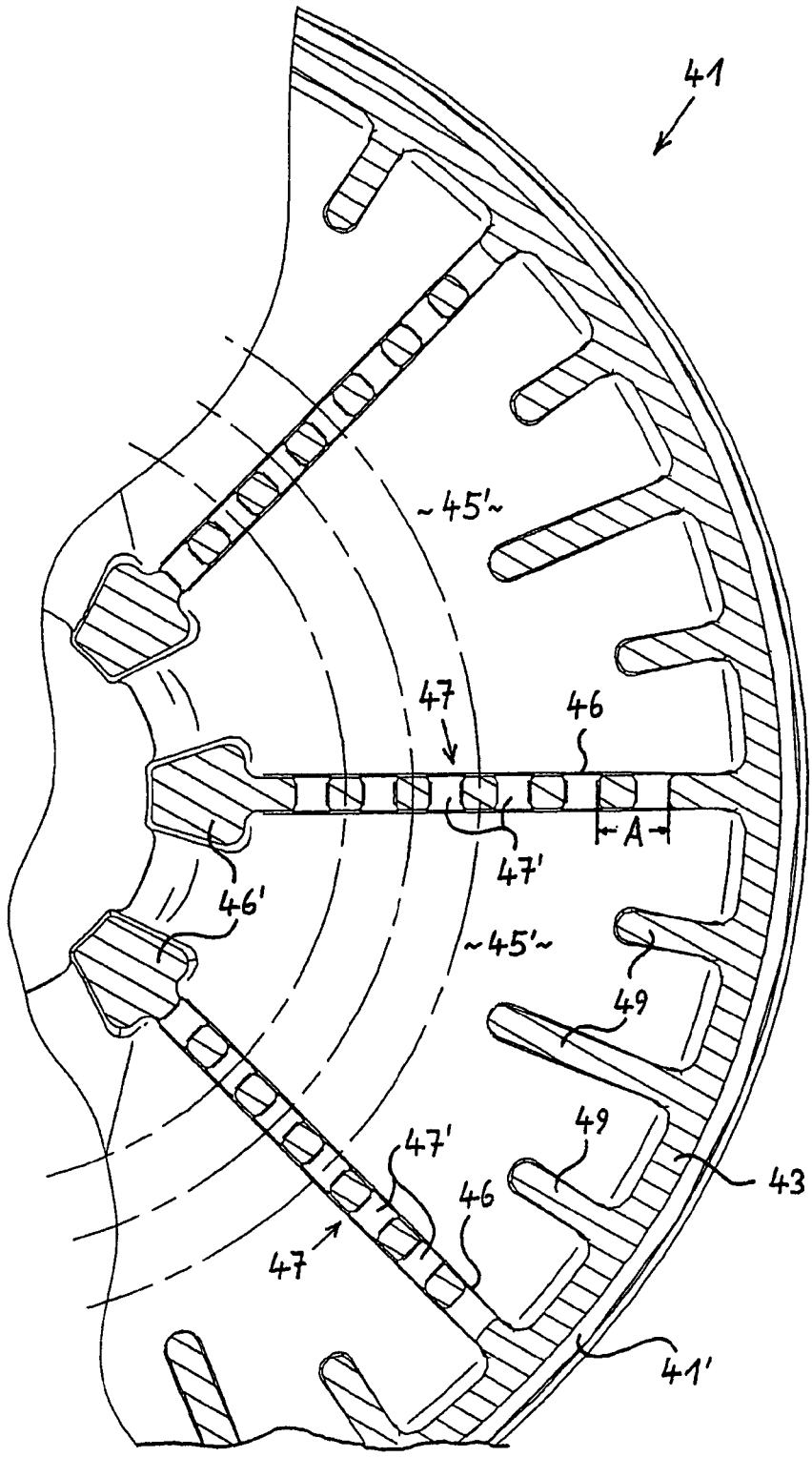
FIG. 4 shows the lower part according to FIG. 3 in a partial cross-section.

FIG. 4 shows a partial cross-section through the lower part 41, with the sectional plane being at such a height that it extends straight through the comb- or tooth-shaped structure 47.

In FIG. 4, the outer circumferential wall 43 with the pertinent welding flange 41' is radially outward. From the circumferential wall 43, the lower deflecting baffle parts 46 extend in one piece with it in radial direction towards the inside. On their radial inside end, the lower deflecting baffle parts 46 each have an edge thickening 46' but they are not connected with each other.

Between two adjacent lower deflecting baffle parts 46 each, the additional ribs 49 are arranged in one piece with the circumferential wall 43.

The comb- or tooth-shaped structure 47 comprises in each case a regular sequence of comb tips and openings 47' provided in between. The structures 47 have a regular pattern with a pattern distance A. The comparison of two in circumferential direction adjacent lower deflecting baffle parts 46 shows that their comb- or tooth-shaped structures 47 are offset relatively to each other in radial direction, with the dimension of this offset amounting to half the pattern distance A. As indicated by the three broken circular line sections in FIG. 4, seen in circumferential direction, one opening 47' each and one comb tip follow after the other. This will prevent continuous flow paths for the liquid in circumferential direction.

Figure 5:
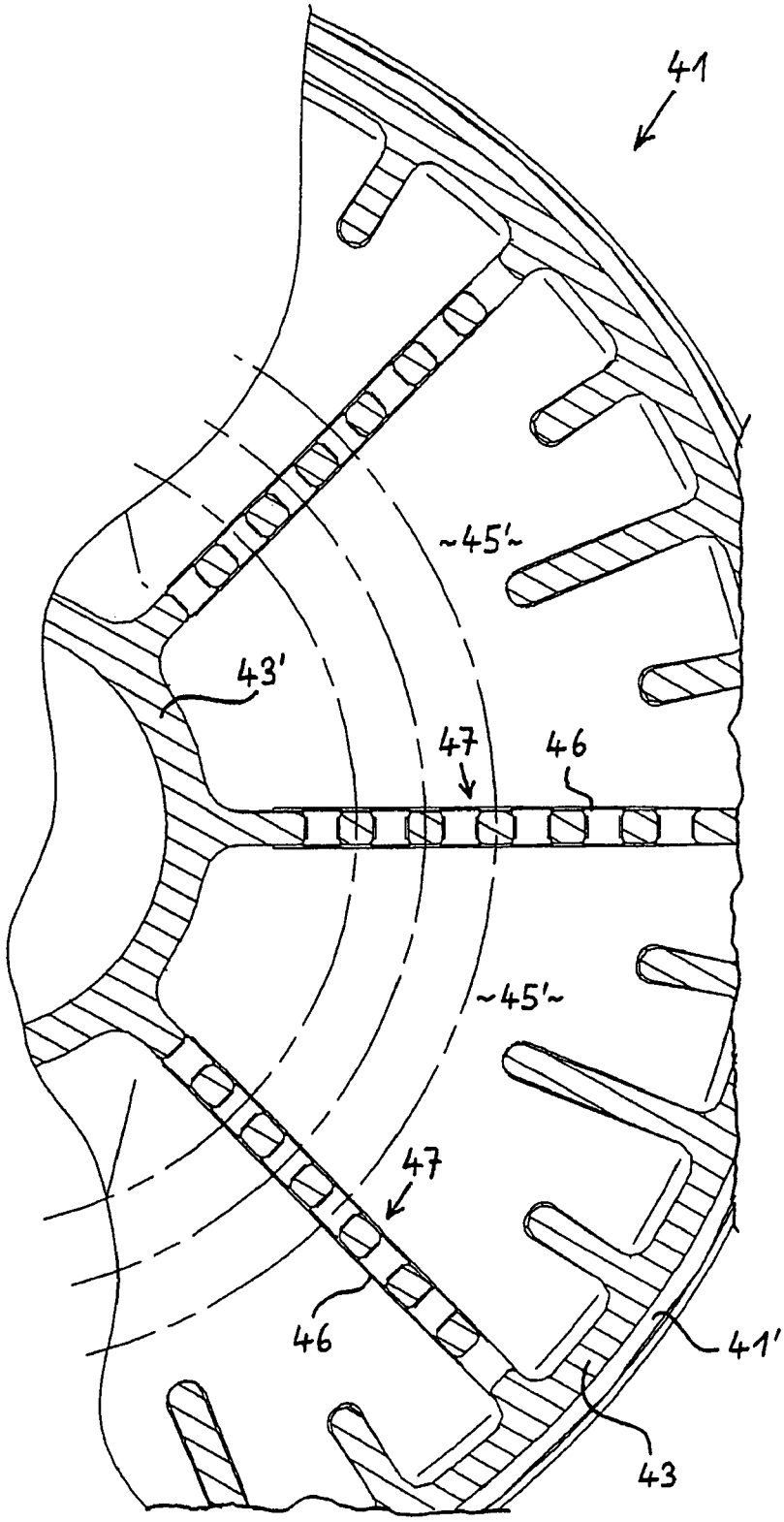
FIG. 5 shows the lower part also in a partial cross-section, in a modified embodiment.

Finally, FIG. 5 shows a modification of the lower part 41 of FIG. 4, also in a partial cross section. In FIG. 5, the circumferential wall 43, its welding flange 41', the lower deflecting baffle parts 46, and the additional ribs 49 are identical with those of FIG. 4.

Contrary to FIG. 4, the example according to FIG. 5 has the lower deflecting baffle parts 46 not ending freely radially inside but going over in one piece into a radially interior ring wall 43'. In this embodiment, forces acting via the radial lower deflecting baffle parts 46 in radial direction can be transmitted and diverted into the interior ring wall 43'. The lower part 41 according to FIG. 5 is expediently used together with a correspondingly designed top part—i.e. also with a congruent radial interior ring wall 43'—to form an impurity trapping element which comprises the radially interior ring wall 43' over one part of its height or over its entire axial height.

In the exemplary embodiments so far described, the lower deflecting baffle parts 46 and the top deflecting baffle parts 48 are running in a straight line in radial direction as well as respectively congruent to each other. An exemplary embodiment modified in this respect is shown in FIGS. 6 and 7.

Figure 6:
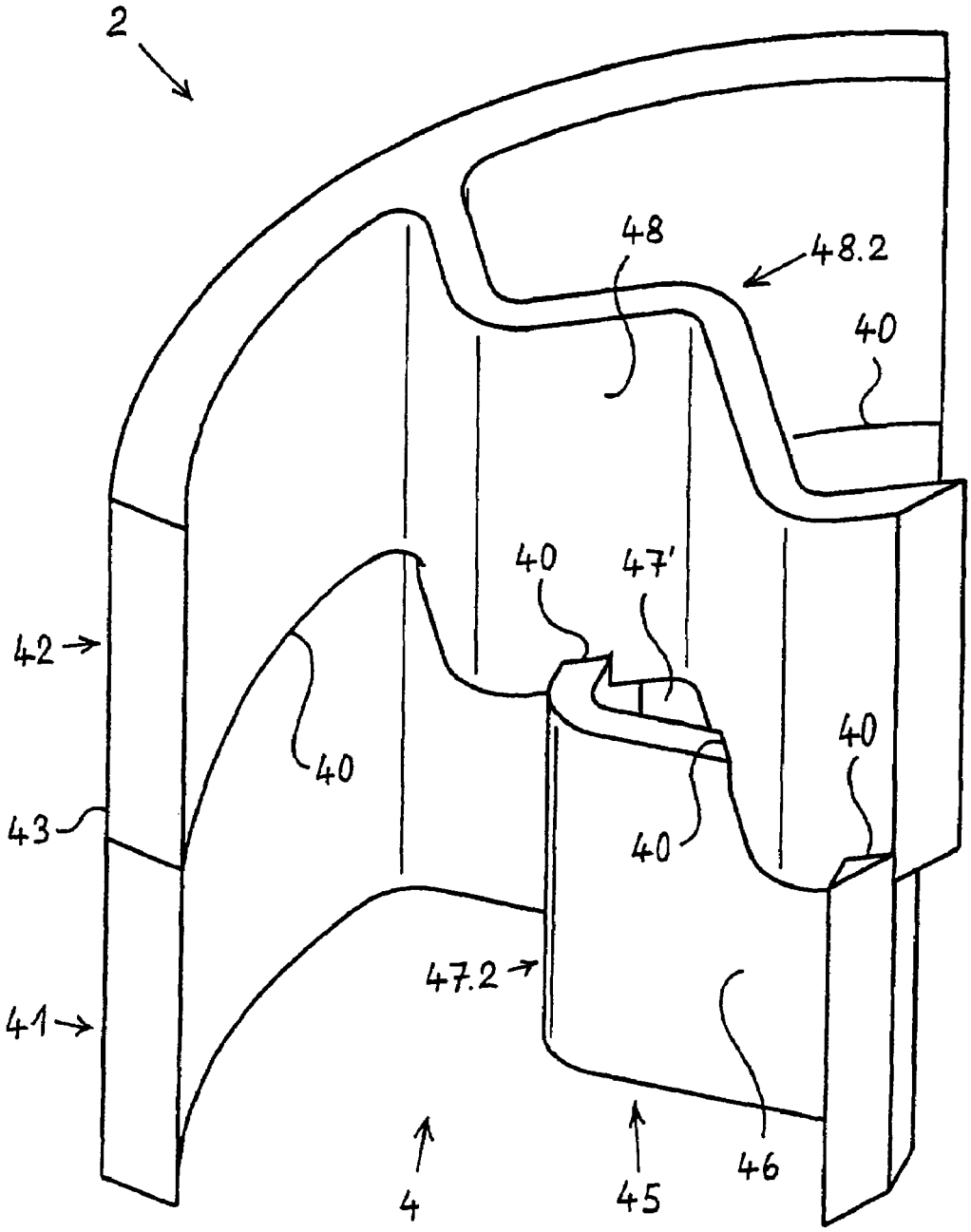
FIG. 6 shows a section of the rotor in another embodiment, viewed at an angle from above.
Figure 7:
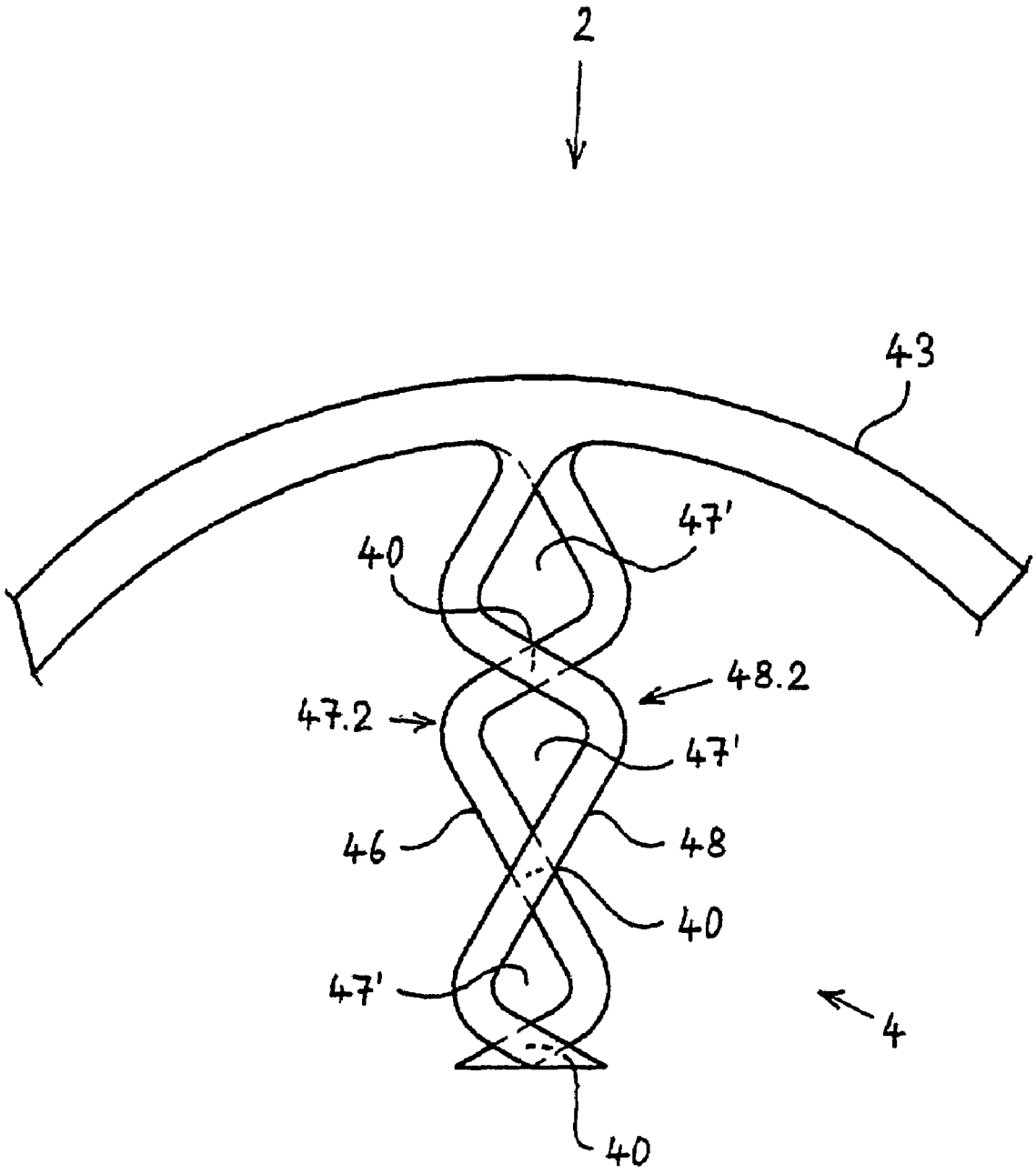
FIG. 7 shows the section of the rotor according to FIG. 6 in a top view.

In the section of rotor 2 presented in FIG. 6, a section of the lower part 41 of the impurity trapping element 4 is visible on the bottom, and a section of the top part 42 is visible on the top. On the left and in the rear of FIG. 6, a corresponding section of the radially exterior circumferential wall 43 is shown, delimiting the impurity trapping element 4 radially towards the outside. Radially on the inside thereof, i.e. in FIG. 6 towards the right, a lower deflecting baffle part 46 extends from the circumferential wall 43 in the lower part 41, and a top deflecting baffle part 48 in the top part 42.

The two deflecting baffle parts 46 and 48 are here designed with a wave-shaped structure 47.2 and 48.2 respectively, with the peaks of the wave crests or the wave troughs respectively facing in circumferential direction of the rotor 2. Moreover, relative to each other in radial direction, the wave-shaped structures 47.2 and 48.2 have an offset which is here equivalent to approximately half the wave length of the wave-shaped structure. Radially outwardly in the area of the circumferential wall 43, the lower part 41 and the top part 42 are welded tightly with each other all around along the welded connection 40.

As with the above described embodiments, here too, the deflecting baffles 45—each comprising the deflecting baffle parts 46 and 48—are incorporated into the welded connection 40, i.e. in each case in those areas in which the waved deflecting baffle parts 46 and 48 are crossing over. Openings 47' are formed in those areas which are each located, in radial direction, between two crossing areas of the lower deflecting baffle part 46 and the top deflecting baffle part 48. These openings 47' connect the chambers of the impurity trapping element 4 which are adjacent to each other in circumferential direction and formed by the deflecting baffles 45.

FIG. 7 shows the section presented in FIG. 6 of the impurity trapping element 4 of the rotor 2 in a top view. On the top in FIG. 7, a section of the circumferential wall 43 is visible. The waved lower deflecting baffle parts 46 and the top deflecting baffle parts 48 facing in their basic orientation in radial direction are extending inwardly from the circumferential wall. The top view according to FIG. 7 shows especially clearly the waved structures 47.2 and 48.2 of the deflecting baffle parts 46 and 48 as well as their offset in radial direction relative to each other. At the crossing areas of one lower deflecting baffle part 46 and one top deflecting baffle part 48 each, there is a welded connection area 40 each which provides for a solid bond of the lower part and the top part of the impurity trapping element 4 even radially inside of the circumferential wall 43.

Seen in radial direction, one of the openings 47' each is formed between two adjacent welded connection areas 40 in each case.

The complete impurity trapping element 4 is provided—aside from the two deflecting baffle parts 46 and 48 which are visible in FIGS. 6 and 7—with additional identically designed deflecting baffle parts 46 and 48 which are regularly spaced from each other in circumferential direction of the impurity trapping element 4.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A rotor for a centrifuge for purifying lubricating oil in an internal combustion engine, comprising:

the rotor being rotatably mounted on a rotary axis in a centrifuge housing and provided with an impurity trapping element having an impurity collecting area which is delimited radially towards the outside by means of a circumferential wall, at least the impurity trapping element being made of a plastic material, a plurality of deflecting baffles being provided on the interior of the impurity trapping element which are spaced apart from each other in circumferential direction, at least the impurity trapping element able to be removed from the centrifuge housing for maintenance purposes, at least the impurity trapping element comprising a lower part and a top part;

the lower part comprising lower deflecting baffle parts and the top part comprising top deflecting baffle parts;

the lower part and the top part being congruently welded with each other at a welded connection;

the deflecting baffle parts being incorporated into the welded connection; and chambers being formed in the impurity trapping element, delimited by the deflecting baffles, which are connected to each other in a fluid permeable manner by openings which are provided through the deflecting baffles at at least one of above, below and at a plane of the welded connection.

2. The rotor according to claim 1, wherein the welded connection is provided in a joining plane extending perpendicularly to the rotary axis.

3. The rotor according to claim 1, wherein the lower deflecting baffle parts have a front side which faces a front side of the top deflecting baffle parts, and the baffle plates extend congruously to each other at their front sides over their entire length.

4. The rotor according to claim 1, wherein each of the lower deflecting baffle parts has a front side which faces and forms a pair with a front side of each of the top deflecting baffle parts, and at least one each pair of facing front sides having a comb- or tooth-shaped structure extending in an axial direction.

5. The rotor according to claim 4, wherein the comb- or tooth-shaped structures of the deflecting baffle parts adjacent to each other in circumferential direction comprise an offset in radial direction relative to each other.

6. The rotor according to claim 5, wherein the number of deflecting baffles is even, the comb- or tooth-shaped structures form a regular pattern with a pattern space A, and the offset is equivalent to half the pattern space.

7. The rotor according to claim 4, wherein the comb- or tooth-shaped structure is only provided in the lower part.

8. The rotor according to claim 7, wherein the lower deflecting baffle parts seen in circumferential direction comprise a greater wall thickness than the top deflecting baffle parts.

9. The rotor according to claim 1, wherein the lower deflecting baffle parts have a front side which faces a front side of the top deflecting baffle parts, and the top and lower baffle parts follow a course deviating from each other over part of their length along their front sides.

10. The rotor according to claim 9, wherein at least one of the lower deflecting baffle parts and the top deflecting baffle parts have, at least in the area of their front side facing the respectively other deflecting baffle parts, a wave- or zigzag-shaped structure extending in the radial direction.

11. The rotor according to claim 10, wherein the wave- or zigzag-shaped structures of the deflecting baffle parts adjacent to each other in axial direction comprise an offset in radial direction relative to each other to form the openings.

12. The rotor according to claim 11, wherein the wave- or zigzag-shaped structures each form a regular shape with a wave length A, and the offset equals half the wave length.

13. The rotor according to claim 1, wherein the number of the deflecting baffles is in the range of six to ten.

14. The rotor according to claim 1, wherein the lower deflecting baffle parts are fabricated in one piece with the lower part, the top deflecting baffle parts are fabricated in one piece with the top part, and the lower part and the top part are each an injection molded part.

15. The rotor according to claim 1, wherein the deflecting baffle parts have a radially inward free end comprising an axially extending edge and the edge is provided with a stiffening enlargement.

16. The rotor according to claim 1, wherein the deflecting baffles terminate at a radially inward end at an interior ring wall by one of being integrally formed with the ring wall, form-fittingly engaging the ring wall and frictionally engaging the ring wall.

17. The rotor according to claim 1, wherein, in at least one of the lower part and the top part, seen in circumferential direction, at least one rib is provided between each of the deflecting baffles, which ribs extend radially towards the inside from the circumferential wall and which are radially shorter than the deflecting baffle parts.

18. The rotor according to claim 1, wherein the lower part has a smaller axial height than the top part, with the height of the lower part being between 20% to 50% of the height of the top part.

19. The rotor according to claim 1, wherein the lower part and the top part are each formed with a welded flange on their circumferential wall.

20. The rotor according to claim 1, wherein the welded connection is a welded connection produced by one of arc welding and butt welding.

21. The rotor according to claim 1, wherein the plastic material of which the lower part and the top part are made is polyamide.

* * * * *